US006660366B1

(12) United States Patent
Simpson

(10) Patent No.: US 6,660,366 B1
(45) Date of Patent: Dec. 9, 2003

(54) INTERLOCKING FASTENING AND PACKING MATERIAL

(76) Inventor: Eugene D. Simpson, 490 Cambridge Ave., Palo Alto, CA (US) 94306

( * ) Notice: Subject to any disclaimer, the term of this patent is extended or adjusted under 35 U.S.C. 154(b) by 0 days.

(21) Appl. No.: 09/127,139

(22) Filed: Jul. 31, 1998

(51) Int. Cl.[7] ..... B32B 3/28

(52) U.S. Cl. ..... 428/182; 428/59; 428/101; 428/183; 428/906

(58) Field of Search ..... 428/100, 101, 428/182, 59, 174, 183, 906; 156/205

(56) References Cited

U.S. PATENT DOCUMENTS

| | | | | |
|---|---|---|---|---|
| 1,849,065 A | | 3/1932 | Biederman | |
| 2,513,777 A | * | 7/1950 | Andre | 156/209 |
| 3,266,113 A | | 8/1966 | Flanagan | |
| 3,308,006 A | * | 3/1967 | Kresse et al. | 428/182 |
| 3,557,413 A | | 1/1971 | Engle | |
| 3,574,103 A | * | 4/1971 | Latkin | 428/182 |
| 3,935,360 A | * | 1/1976 | Brown | 428/184 |
| 3,975,882 A | * | 8/1976 | Walter | 428/182 |
| 4,474,293 A | | 10/1984 | Osborne | 206/497 |
| 4,748,067 A | * | 5/1988 | Cline | 428/186 |
| 5,094,385 A | | 3/1992 | Antczak et al. | 229/110 |
| 5,358,174 A | | 10/1994 | Antczak et al. | 229/110 |
| 5,733,403 A | * | 3/1998 | Morley | 156/207 |
| 5,888,621 A | * | 3/1999 | Frohlich et al. | 428/182 |

FOREIGN PATENT DOCUMENTS

| | | |
|---|---|---|
| EP | 0 263 587 | 4/1988 |
| EP | 0 389 130 | 9/1990 |
| EP | 0 418 951 | 3/1991 |

* cited by examiner

*Primary Examiner*—Donald J. Loney
(74) *Attorney, Agent, or Firm*—Morrison & Foerster LLP

(57) ABSTRACT

An interlocking fastening and packing material is disclosed. The material may be utilized for fastening of a plurality of objects together and/or for protecting one or more object(s) disposed therein, particularly during storage, handling and/or shipping. The material comprises corrugations which include alternating concave and convex portions shaped such that each concave portion is receivable and interlockable with a convex portion therein. The corrugations may be elongate or may comprise a matrix of bulbous nodules. The material may further comprise a backing material having two opposing surfaces wherein corrugations are attached to at least one of the two surfaces. A single piece of the interlocking material may be used by overlapping and interlocking one portion of the material with another portion thereof. Multiple pieces of the interlocking material may also be overlapped and interlocked together.

18 Claims, 3 Drawing Sheets

INTERLOCKING FASTENING AND PACKING MATERIAL

FIELD OF THE INVENTION

The present invention is an interlocking fastening or packing material. More particularly, the present invention is a fastening and packing material having interlocking corrugations which can be utilized for fastening and/or for providing protection to an object stored therein.

BACKGROUND OF THE INVENTION

The fastening of articles often requires the use of fastening mechanisms such as adhesives, strings, ropes, or adherent textured fabrics, for example, Velcro, which may be difficult to adjust, reposition and/or remove. For example, Velcro may be utilized instead of, for example, buttons, shoe laces, strings, buckles and any other suitable elements on apparel to provide an easily manipulated and easily adjustable fastening mechanism. However, the use of Velcro may cause damage to the article to be fastened due to the amount of force needed to unfasten the Velcro for removal or repositioning. Adhesives may also cause damage to the article to be fastened and it may be difficult to unfasten the articles held together by adhesives. Thus, it is desirable to provide a mechanism for fastening which is easily manipulated, repositionable, adjustable, removable and which does not cause damage to the articles to be fastened.

Further, such conventional fastening mechanisms are not designed to simultaneously protect the articles during storage, handling and/or shipping. Packaging of articles for storage, handling and shipping often relies upon the use of a box filled with various types of filler materials such as Styrofoam "peanuts," popcorn, foam rubber and expanded starch packing material. However, these packing materials are inconvenient and/or undesirable in that they create debris which preferably is recycled but often is not. Storage of the packing material prior to use also consumes a large amount of storage space. Thus, it is desirable to provide a mechanism for the simultaneous fastening and protection of articles.

SUMMARY OF THE INVENTION

The present invention is an interlocking fastening and packing material generally comprising a backing having two opposing surfaces and having corrugations attached to one or both of the backing surfaces. The corrugations include alternating concave and convex portions which are shaped such that each concave portion can receive and interlock with a convex portion therein. The corrugations may be elongate or may comprise a matrix of bulbous nodules.

DESCRIPTION OF THE INVENTION

The present invention comprises an interlocking fastening and packing material for protecting objects, particularly during shipping. The following description is presented to enable any person skilled in the art to make and use the invention. Descriptions of specific applications are provided only as examples. Various modifications to the preferred embodiment will be readily apparent to those skilled in the art, and the general principles defined herein may be applied to other embodiments and applications without departing from the spirit and scope of the invention. Thus, the present invention is not intended to be limited to the embodiments shown, but is to be accorded the widest scope consistent with the principles and features disclosed herein.

Figure 1A:
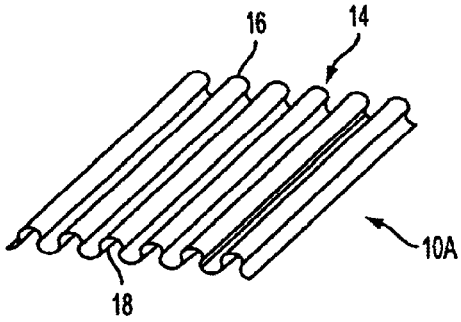
FIG. 1A shows a perspective view of an interlocking fastening and packing material of the present invention having elongate corrugations.
Figure 1B:
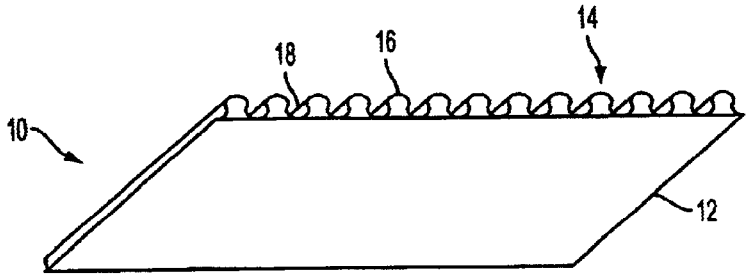
FIG. 1B shows a perspective view of the interlocking fastening and packing material of FIG. 1A having a backing material attached to the corrugations.

A perspective view of a single piece of the interlocking fastening and packing material 10A of the present invention is shown in FIG. 1A. The interlocking material 10A generally comprises interlocking corrugations 14. Preferably, each of corrugations 14 is elongated. Corrugations 14 may be attached to one or both surfaces or sides of the backing 12. For example, FIG. 1B shows a perspective view of the interlocking fastening and packing material 10 having corrugations 14 on only one side or surface of the backing 12. The backing 12 may provide increased stiffness and/or stability to the interlocking material 10. As is evident, where material 10 is provided without a backing, corrugations 14 of interlocking material 10A is preferably relatively stiff and rigid such that corrugations 14 can maintain their shapes. For example, corrugations 14 of interlocking material 10A can be made of a relatively stiff and rigid material and/or can have a thin plastic coating or other types of coatings and/or additives for increased stiffness and rigidity.

Figure 2:
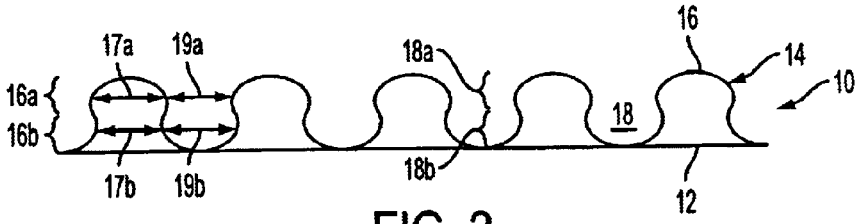
FIG. 2 shows a cross-sectional view of the interlocking fastening and packing material of FIG. 1.

One variation of the corrugations 14 of the interlocking fastening and packing material 10 or 10' is shown in cross-section in more detail in FIG. 2. The corrugations 14 comprise alternating convex portions or protrusions 16 and concave portions or spaces 18 which are preferably defined by two adjacent convex portions 16. Each of convex and concave portions 16, 18 defines a free end portion 16*a*, 18*a* and a surface portion 16*b*, 18*b* respectively. Preferably, the cross-sectional shape and size of the free end convex portions 16*a* are generally the same as or similar to those of the surface concave portions 18*b*. Similarly, the cross-sectional shape and size of the surface convex portions 16*b* are generally the same as or similar to those of the free end concave portions 18*a*.

The upper diameter 17*a* of free end convex portion 16*a* is preferably approximately equal to the lower diameter 19*b* of surface concave portion 18*b*. Similarly, the upper diameter 19*a* of surface concave portion 18*a* is preferably approximately equal to the lower diameter 17*b* of surface convex portion 16*b*. Further, diameters 17*a*, 19*b*, are preferably greater than diameters 19*a*, 17*b*.

Such configuration of the convex and concave portions 16, 18 of interlocking corrugations 14 ensures that the each free end convex portion 16*a* can be received in and interlocked with a surface concave portion 18*b* and that each surface convex portions 16*b* can be received in and interlocked with a free end concave portion 18*a*. In other words, one portion of the corrugations 14 of material 10 can be interlocked with another portion thereof or with the corrugations of another piece of the interlocking material.

As shown in FIG. 2, corrugations 14 preferably is shaped such that the cross-sectional shape of each of the free end convex portions 16*a* and the surface concave portions 18*b* is generally semi-circular. As is evident, corrugations 14 may have any shape suitable for each surface concave portion 18*b* to receive and interlock with a free end convex portion 16*a*. Preferably, each of free end portions 16*a*, 18*a* and surface portions 16*b*, 18*b* is preferably rounded to facilitate the insertion of a convex portion 16 into a concave portion 18 as well as to facilitate the removal of the convex portion 16 from the concave portion 18.

Figure 3A:
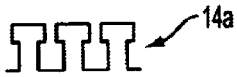
FIGS. 3A, 3B and 3C show variations of the cross-sectional shape of the corrugations.
Figure 3B:
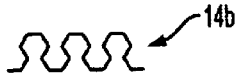
Figure 3C:
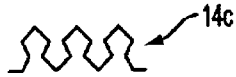

Examples of alternative shapes of corrugations 14*a*, 14*b*, and 14*c*, are shown in FIGS. 3A, 3B and 3C, respectively. Specifically, free end convex portions of corrugations 14*a*, 14*b*, and 14c may have a generally rectangular, hexagonal and rhombus cross-sectional shape, respectively.

A single or multiple pieces of the interlocking material 10 of the present invention may be utilized as a packing material to protect one or more objects contained therein. Additionally or alternatively, the single or multiple pieces of the interlocking material 10 may be utilized as a fastening material for fastening a plurality of objects contained therein.

Figure 4A:
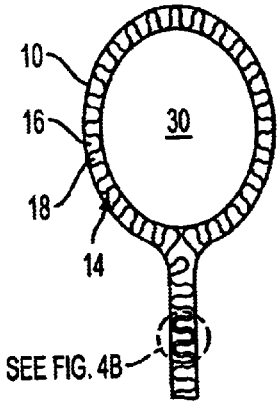
FIG. 4A shows a cross-sectional view of an interlocked single piece of the interlocking fastening of FIG. 1B containing an object therein.
Figure 4B:
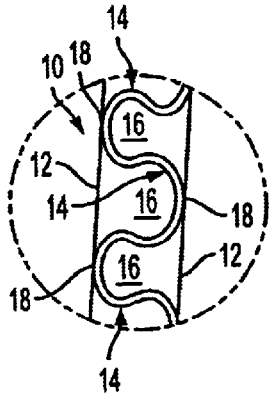
FIG. 4B shows an enlarged view of the cross-sectional portion 4B of FIG. 4A.

FIG. 4A shows a cross-sectional view of a single piece of interlocking material 10 containing an object 30 therein by interlocking portions of the interlocking material 10. In addition, FIG. 4B shows an enlarged view of the cross-sectional portion 4B of FIG. 4A. As shown, a plurality of convex portions 16 are received in and interlocked with a plurality of concave portions 18. The interlocking position, i.e. the specific convex portion 16 to be received in and interlocked with a particular concave portion 18, is determined by the size and the positioning of the object 30 within the interlocking material 10.

Figure 4C:
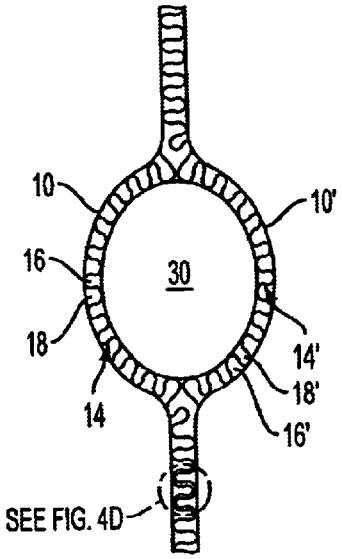
FIG. 4C shows a cross-sectional view of two interlocked pieces of the interlocking fastening of FIG. 1B containing an object therein.
Figure 4D:
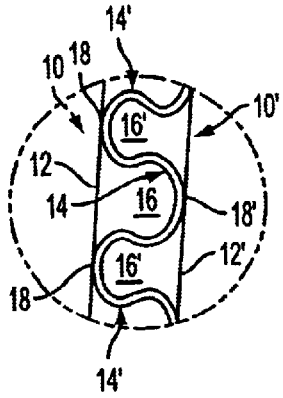
FIG. 4D shows an enlarged view of the cross-sectional portion 4D of FIG. 4C.

Alternatively, the object 30 may be contained by two or more pieces of interlocking material 10, 10', portions of which are interlocked to each other as shown in cross-section in FIG. 4C. In addition, FIG. 4D shows an enlarged view of the cross-sectional portion 4D of FIG. 4C. As shown, a plurality of convex portions 16 of interlocking material 10 are received in and interlocked with a plurality of concave portions 18' of interlocking material 10'. Similarly, a plurality of convex portions 16' of interlocking material 10' are received in and interlocked with a plurality of concave portions 18 of interlocking material 10. The interlocking position, i.e. the specific convex portion 16, 16' to be received in and interlocked with a particular concave portion 18, 18', respectively, is determined by the size and the positioning of the object 30 within the interlocking material 10, 10'. Clearly, the one or more pieces of the interlocking material provide several discrete interlocking positions for containing one or more objects 30 therein.

Figure 4E:
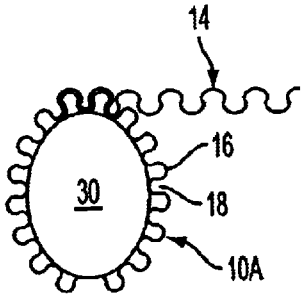
FIG. 4E shows a cross-sectional view of an interlocked single piece of the interlocking fastening of FIG. 1A containing an object therein.

FIG. 4E shows a cross-sectional view of a single piece of interlocking material 10A of FIG. 1A containing an object 30 therein by interlocking portions of the interlocking material 10A. Because interlocking material 10A does not include a backing, each convex portion 16 is a concave portion 18 when viewed from the opposing side. Thus, as shown, when the interlocking material 10A is wrapped around object 30 and overlaps with itself, one or more convex portions 16 are overlapped and interlocked with one or more convex portions 16 in another part of the interlocking material 10A. Similarly, one or more concave portions 18 are overlapped and interlocked with one or more concave portions 18 in another part of the interlocking material 10A. Further, the interlocking position, i.e. the specific convex portion 16 to be overlapped and interlocked with a particular other convex portion 16, is determined by the size and positioning of the object 30 within the interlocking material 10. The interlocking position is also determined by the amount that the interlocking material 10A stretches due to the lack of a backing, which in part depends upon the rigidity of the corrugations 14.

Figure 5A:
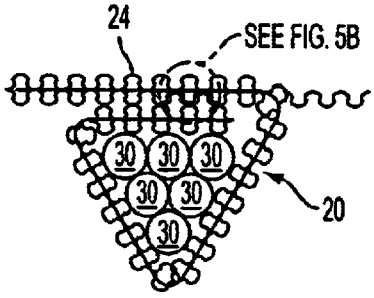
FIG. 5A shows a cross-sectional view of the interlocking fastening and packing material of the present invention having corrugations on both surfaces of the backing material and containing a plurality of objects therein.
Figure 5B:
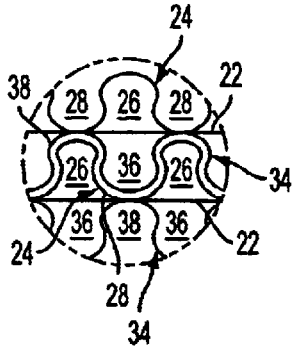
FIG. 5B shows an enlarged view of the cross-sectional portion 5B of FIG. 5A.

FIGS. 5A and 5B show a single piece of interlocking material 20 having corrugations 24, 34 on both surfaces of backing 22 and containing a plurality of objects 30 therein. Corrugations 24 attached to a first surface of the backing 22 comprises alternating convex portions 26 and concave portions 28. Similarly, corrugations 34 attached to a second surface of the backing 22 comprises alternating convex portions 36 and concave portions 38. Providing corrugations on both surfaces of backing also provides additional protection to the objects contained in the interlocking material.

To contain the objects 30 within the interlocking material 20, the user may simply wrap the interlocking material 20 around the objects 30 until a portion thereof overlaps with another portion thereof to allow for interlocking of the two portions. The interlocking mechanism is similar to that described above wherein a plurality of convex portions are received in and interlocked with a plurality of concave portions. Specifically, a plurality of convex portions 26 on the first surface of backing 22 are received in and interlocked with a plurality of concave portions 38 on the second surface of backing 22. Similarly, a plurality of convex portions 36 on the second surface of backing 22 are received in and interlocked with a plurality of concave portions 28 on the first surface of backing 22. The interlocking position, i.e. the specific convex portion 26, 36 to be received in and interlocked with a particular concave portion 38, 28, respectively, is determined by the size and the positioning of the objects 30 within the interlocking material 20. Clearly, interlocking material 20 provides several discrete interlocking positions for containing objects 30 therein.

Figure 6A:
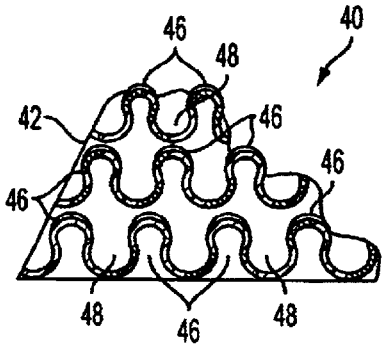
FIG. 6A shows a partial perspective view of another interlocking fastening and packing material of the present invention having corrugations formed of an array or matrix of bulbous nodules.
Figure 6B:
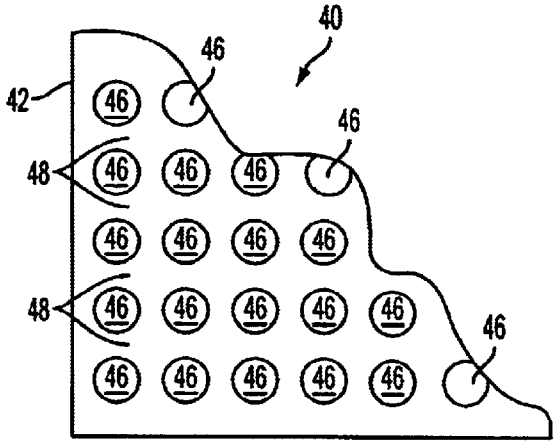
FIG. 6B shows a top view of the interlocking fastening and packing material of FIG. 6A.

FIGS. 6A and 6B show another interlocking fastening and packing material 40 having a backing 42 and corrugations 44 on one side of the backing 42, although corrugations may be provided on both sides thereof. The corrugations 44 of material 40, rather than being elongate, comprise an array or matrix of bulbous nodules 46 with corresponding concave portions or spaces 48 therearound. The cross-sectional shape of each of bulbous nodule 46 is similar to that of convex portions of the corrugations 14, 14*a*, 14*b* or 14*c* as shown in FIGS. 2, 3A–C. As is evident, bulbous nodules 46 may have any suitable cross-sectional shape such that each concave portion 48 can receive and interlock with a nodule 46. Although not shown, material 40 may be provided without a backing. Where material 40 is provided without a backing, corrugations 44 is preferably relatively stiff and rigid such that corrugations 44 can maintain their shapes without the support of a backing.

Figure 6C:
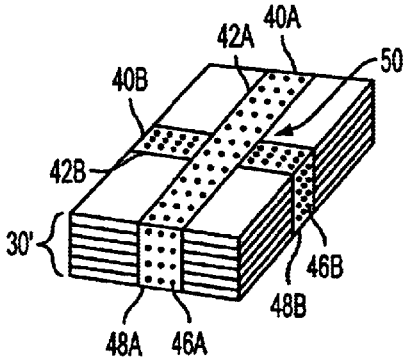
FIG. 6C shows a perspective view of the two pieces of the interlocking fastening and packing material of FIG. 6A containing a plurality of objects therein.

FIG. 6C illustrates an example of interlocking materials 40A, 40B, each interlocked to itself as well as to each other to secure and/or protect one or more objects 30'. Each of materials 40A and 40B comprises bulbous nodules 46A, 46B and spaces 48A, 48B on both sides of backing 42A, 42B, respectively, although only one surface of each of backing 42A, 42B is visible in FIG. 6C.

Material 40B may be first wrapped around objects 30' and secured onto itself by overlapping and interlocking one or more bulbous nodules 46B disposed on the surface of backing 42B hidden in FIG. 6C with one or more spaces 48B on the surface of backing 42B visible in FIG. 6C, although the overlapped portion is not shown. Material 40A may then be placed over a portion of material 40B and interlocked therewith at, for example, an approximately 90° angle relative to material 40B. Material 40A may then be partially wrapped around objects 30' until it overlaps with material 40B, such as the overlapped portion 50. The material 40A is then interlocked with material 40B at, for example, an approximately 90° angle relative to material 40B. Finally, material 40A is completely wrapped around objects 30' and secured onto itself in a manner similar to that described above.

As is evident, depending upon the specific arrangement and spacing of the array or matrix of bulbous nodules 46, interlocking fastening and packing material 40 can be interlocked with itself or with another material at a plurality of angles relative to itself or material 40. Further, providing interlocking fastening and packing material 40 with a matrix of bulbous nodules 46 rather than elongate corrugations may also increase the interlocking strength.

Any suitable material or combinations of materials may be utilized for the interlocking material of the present invention, depending on the intended use of the interlocking material, such as the objects to be contained, the desired level of protection to the objects, and other factors. Preferably, the corrugations comprise a material sufficiently rigid to facilitate interlocking of and maintaining the interlocked state of the corrugations. The corrugations may comprise the same or similar materials as the backing and may further comprise a coating or an additive to further provide rigidity to and further strengthen the corrugations.

For example, the backing and the corrugations may be made of cardboard similar to that of corrugated cardboard such as kraft paper or other similar paper stock. Alternatively, materials such as fabric, cloth, polyethylene terephthalate (Mylar), polyethylene sheet, polypropylene (clear or fibrous paper product), or the like may also be suitable. Further, the backing of the interlocking material may be creased and/or partially scored to facilitate forming the interlocking material into a desired shape.

The interlocking material of the present invention may be supplied to the user in the form of a roll. The user may simply cut off a desired length of the interlocking material for use in any of numerous applications. As described above, the interlocking material may provide protection to the objects contained therein during storage, handling and/or shipping. Additionally or alternatively, the interlocking material may be utilized as a fastening material for applications similar but not limited to those of, for example, VELCRO, adhesive tape, ropes and any other fastening mechanisms.

While specific embodiments of the invention have been described and illustrated, it will be appreciated that modifications can be made to these embodiments without departing from the spirit of the invention. Thus, the invention is intended to be defined in terms of the following claims.

What is claimed is:

1. A backingless interlocking sheet material, comprising:

elongated hollow interlocking corrugations not attached to a backing comprising a plurality of alternating concave and convex hollow interlocking corrugations having upper portion diameters and lower portion diameters, said concave and convex elongated hollow interlocking corrugations being shaped such that said convex hollow interlocking corrugations are receivable into, interlockable with, and removable from openings between said convex elongated hollow interlocking corrugations and the upper portion diameters are larger than the lower end diameters, said backingless interlocking sheet material further comprising a first portion and a second portion overlapped with said first portion.

2. The backingless interlocking material of claim 1, wherein said interlocking corrugations comprise at least one member selected from the group consisting of polyethylene terephthalate, polyethylene, polypropylene, and paper.

3. The backingless interlocking material of claim 2, wherein said interlocking corrugations comprise paper.

4. The backingless interlocking material of claim 2, wherein said interlocking corrugations further comprise a coating.

5. The backingless interlocking material of claim 3, wherein said interlocking corrugations further comprise a coating.

6. The backingless interlocking material of claim 3 wherein said interlocking corrugations further comprise a plastic coating.

7. The backingless interlocking material of claim 2 wherein said interlocking corrugations further comprise at least one additive selected to increase stiffness of the sheet material.

8. The backingless interlocking material of claim 2 wherein said interlocking corrugations are shaped to have concave and convex sections that are semi-circular in cross-section.

9. The backingless interlocking material of claim 2 wherein said interlocking corrugations are shaped to have concave and convex sections that are bulbous in cross-section.

10. A method of making the backingless sheet material of claim 1 comprising:

(a.) taking a backingless interlocking sheet material, comprising: elongated hollow interlocking corrugations not attached to a backing comprising a plurality of alternating concave and convex hollow interlocking corrugations, said concave and convex elongated hollow interlocking corrugations being shaped such that said convex hollow interlocking corrugations are receivable into, interlockable with, and removable from one another, and wherein said backingless interlocking sheet material has a wrapped configuration when said sheet material is wrapped around an object; and (b.) forming the sheet material from step (a.) into said backingless interlocking sheet material of claim 1.

11. The method of claim 10, wherein said interlocking corrugations comprise at least one member selected from the group consisting of polyethylene terephthalate, polyethylene, polypropylene, and paper.

12. The method of claim 11, wherein said interlocking corrugations comprise paper.

13. The method of claim 12 wherein said interlocking corrugations further comprise a coating.

14. The method of claim 12 wherein said interlocking corrugations further comprise a plastic coating.

15. The method of claim 12 wherein said interlocking corrugations further comprise at least one additive selected to increase stiffness of the sheet material.

16. The method of claim 11 wherein said interlocking corrugations further comprise a coating.

17. The method of claim 11 wherein said interlocking corrugations are shaped to have concave and convex sections that are semi-circular in cross-section.

18. A method of making the backingless interlocking sheet material of claim 1 comprising:

(a.) providing a roll of backingless interlocking sheet material, said material comprising elongated hollow interlocking corrugations not attached to a backing, said sheet material further comprising a plurality of alternating concave and convex hollow interlocking corrugations, said concave and convex elongated hollow interlocking corrugations being shaped such that said convex hollow interlocking corrugations are receivable into, interlockable with, and removable from one another;

(b.) taking a piece of said sheet material from said roll of step (a.); and (c.) wrapping said piece of sheet material from step (b.) into said backingless interlocking sheet material of claim 1.

* * * * *